United States Patent [19]

Sawafuji

[11] 4,228,327

[45] Oct. 14, 1980

[54] ELECTROMAGNETIC TYPE ACOUSTIC TRANSDUCERS

[76] Inventor: Tadashi Sawafuji, No. 9-15, Nishi-Sugamo, 1-chome, Toshima-ku, Tokyo, Japan

[21] Appl. No.: 14,301

[22] Filed: Feb. 23, 1979

[30] Foreign Application Priority Data

Feb. 25, 1978 [JP] Japan ..... 53-22931[U]

[51] Int. Cl.[2] ..... H04R 7/18; H04R 9/02

[52] U.S. Cl. ..... 179/115.5 ES; 179/115.5 PV

[58] Field of Search ..... 179/115.5 PV, 115.5 ES, 179/115.5 R

[56] References Cited

U.S. PATENT DOCUMENTS

| | | | |
|---|---|---|---|
| 3,012,107 | 12/1961 | Hanlet | 179/115.5 PV |
| 3,829,623 | 8/1974 | Willis et al. | 179/115.5 PV |
| 3,919,498 | 11/1975 | Beer | 179/115.5 PV |
| 3,979,566 | 9/1976 | Willy | 179/115.5 ES |
| 4,056,697 | 11/1977 | Heil | 179/115.5 PV |
| 4,081,627 | 3/1978 | Crist | 179/115.5 PV |

*Primary Examiner*—Daryl W. Cook

*Attorney, Agent, or Firm*—Cantor and Singer

[57] ABSTRACT

An electromagnetic type acoustic transducer comprises a vibratable diaphragm including a conductor and disposed within a magnetic field defined by a permanent magnet. Support members which are expandable and contractible in the direction at right angles with the diaphragm are fixed to both surfaces of the diaphragm. A frame is provided for fixing the support members such that the expansion and contraction thereof is not prevented. The support members may be folded and formed to a bellows-like state. Use is also made of a conductor forming spiral convolutions. The permanent magnet is disposed and retained at a vibration gap with respect to the diaphragm.

5 Claims, 7 Drawing Figures

ELECTROMAGNETIC TYPE ACOUSTIC TRANSDUCERS

BACKGROUND OF THE INVENTION

The present invention relates to improvements in acoustic transducers of the electromagnetic type including plane-driving type diaphragms, which are intended for use in loudspeakers, earphones, head phones or mocrophones.

For example, an acoustic transducer of the electromagnetic type that includes a vibratable diaphragm having a conductor and disposed within a magnetic field defined by a permanent magnet is described in U.S. Pat. No. 3,919,498 specification. In the transducer of this type, since the diaphragm is secured through a suitable fixing member to the magnet which faces it at its entire peripheral edge and its center, the entire peripheral edge and the center undergo no vibration so that the diaphragm is not plane-driven. Consequently, the transducer of this type is disadvantageous in that the amplitude of the diaphragm is small, resulting in unfaithful reproduction of a low sound range and that the allowable input cannot be raised. The present invention provides an electromagnetic type acoustic transducer which avoids these and other drawbacks.

SUMMARY OF THE INVENTION

According to the present invention there is provided an electromagnetic type acoustic transducer including a vibratatable diaphragm having a conductor and disposed within a magnetic field defined by a permanent magnet. The diaphragm is fixedly provided on both surfaces of its entire peripheral edge with expandable and retractible support members which are, in turn, secured to a frame. The expandable and restorable properties of this diaphragm leads to an increase in the amplitude thereof and makes it possible to plane-drive it in the same phase over its entire surface. In particular, it is possible to faithfully reproduce a low sound range and increase the allowable input.

The above and other features and advantages will be clear from the following detailed description of exemplary preferred embodiments illustrated in the appended drawing.

DETAILED DESCRIPTION OF THE INVENTION

Figure 1:
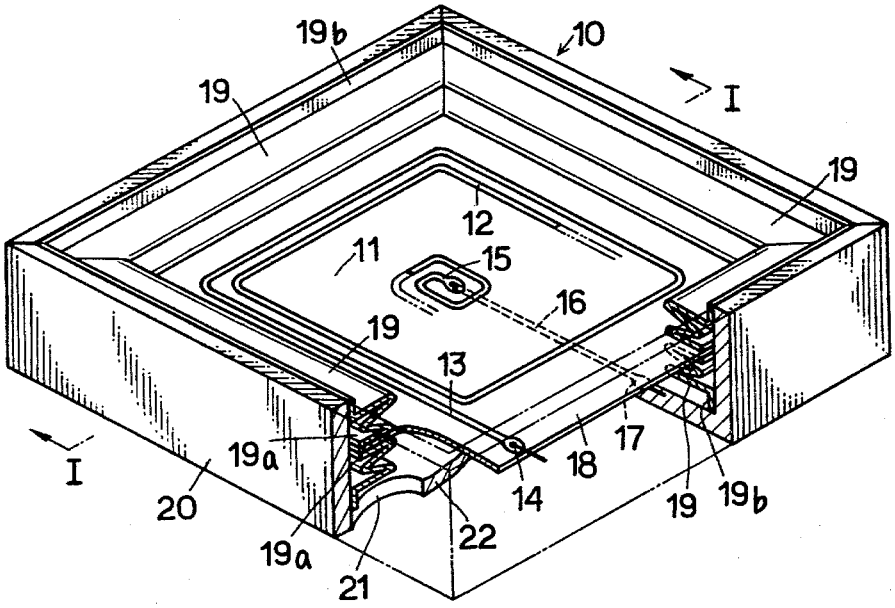
FIG. 1 is a perspective view, partially cut away, of the electromagnetic type acoustic transducer intended for use in head phones according to the present invention, which is enlarged on about two-fold scale and in which the conductor is shown to be partially omitted.
Figure 2:
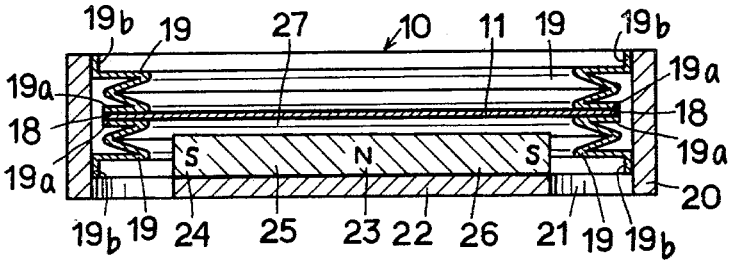
FIG. 2 is a sectional view taken along the line I—I of FIG. 1.

The present invention will now be explained in greater detail with reference to the drawing. FIGS. 1 and 2 generally show a square electromagnetic type acoustic transducer 10 intended for use in head phones. A sound generating element is a flat and square diaphragm 11 which is provided on its upper surface with a square, continuous conductor 12 forming spiral convolutions. The conductor 12 is composed of an aluminium foil of a thickness of about 0.01 mm bonded to a film of about 0.01 to 0.1 mm thickness and made of synthetic resin whose flexibility and rigidity are not substantially affected by changes in room and ambient temperatures, such as polyester, polyethylene, polypropylene or nylon, or a square thin film of about 0.01 to 0.05 mm thickness and made of a non-magnetic metal foil such as titanium or aluminium foil on the conductor-forming surface of which is laminated an insulating thin layer, followed by etching of said aluminium foil. The conductor 12 is also provided at its peripheral edge 13 with a terminal 14, and a back conductor 16 connected electrically to conductor 12 at the center portion 15 of diaphragm 11 is provided at its other end with a terminal 17.

To both surfaces of the entire peripheral edge 18 of diaphragm 11 are firmly bonded tongue pieces **19*a* of bellows-like support members 19 each having a M-shaped configuration in section by means of a suitable strong bonding agent, and to the inside of frame 20 are firmly bonded other tongue pieces 19*b* of the support members 19 by means of a suitable strong bonding agent. In this way, the diaphragm 11 is supported to frame 20 by the support members 19 in suspension fashion. As the material for the support members 19**, use may be made of Japanese paper, cloth or unwoven fabric of the other of about 0.01 to 0.07 mm thickness which is impregnated with silicon rubber paint, or a metallic titanium thin plate of the order of 0.01 to 0.05 mm thickness since they excel in durability and restorable and working properties.

A lower portion of frame 20 is formed integrally with a bottom plate 22 having a number of peripheral perforations. Alternatively, such a bottom plate 22 may be fixed thereto by means of screws. The bottom plate 22 is magnetized in such a manner that it has a north pole at the center 23 and an annular south pole at the periphery 24. A permanent magnet plate 26 of ferrite defining an annular non-magnetized region is secured to a portion between the north and south poles by suitable bonding means such as screws or strong adhesives. A vibration gap 27 between the diaphragm 11 and the upper face of the permanent magnet plate 26 is such that the diaphragm 11 does not come in contact with the plate 26 at the maximum amplitude of diaphragm 11.

When sound current flows through the conductor 12 of diaphragm 11, the diaphragm 11 vibrates over its entire surface according to the Fleming's rule to reproduce a sound. Since the upper and lower portions of the entire peripheral edge of diaphragm 11 is supported by the support members 19 constructed as aforesaid, the diaphragm can well vibrate with a larger amplitude by the expanding and contracting action of the bellows of the support members, resulting in faithful reproduction of a low sound range and an increase in the allowable input.

Figure 3:
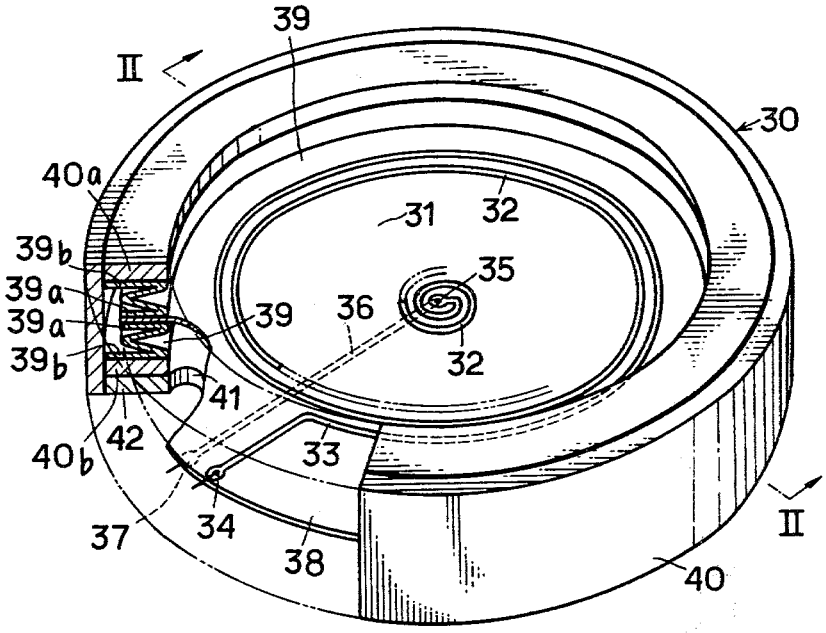
FIG. 3 is a perspective view, partially cut away, of other electromagnetic type acoustic transducer modified for use in head phones according to the present invention, which is enlarged on an about two-fold scale and in which the conductor is shown to be partially omitted.
Figure 4:
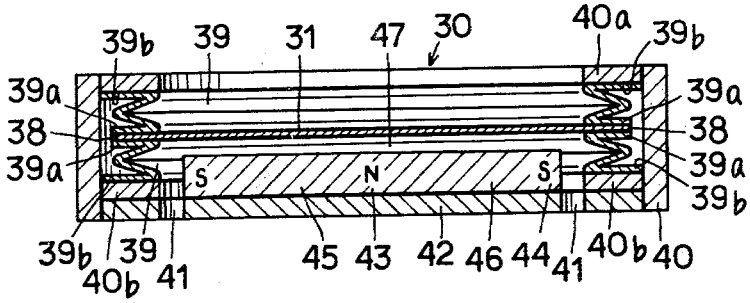
FIG. 4 is a sectional view taken along the line II—II of FIG. 3.

A sound generating element for other electromagnetic type acoustic transducer 30 shown in FIGS. 3 and 4 and designed for use in head phones is a flat, circular diaphragm 31 which is provided on its upper surface with a continuous conductor 32 forming circularly spiral convolutions, which is bonded to a circular thin film of the same material as the diaphragm 11. The conductor 32 is provided at its peripheral portion 33 with a terminal 34, and a back conductor 36 connected electrically to the conductor 32 at the center portion 35 is provided at its other end with another terminal 37.

To both surfaces of the entire peripheral edge 38 of diaphragm 31 are firmly bonded by means of a suitable strong bonding agent tongue pieces 39*a* of bellows-like circular support members 39 which are formed of the same material as the aforesaid support members 19 and have a M-shaped configuration in section. Other tongue pieces 39*b* are firmly bonded by means of a suitable strong bonding agent to annular plates 40*a* and 40*b* which are fixed by screws or other suitable fixing means to the upper and lower portions of a circular frame 40. In this way, the diaphragm 31 is supported to the frame 40 by the support members 39 in suspension fashion.

In view of its production the circular support members comprises at least four pieces which are to be arranged in a circle to the circular support members.

The lower annular plate 40*b* of the frame 40 is provided at its lower portion with a circular bottom plate 42 having perforations 41 in the same manner as in the aforesaid bottom plate 22. The bottom plate 42 is magnetized in such a manner that it has a north pole at the center 43 and an annular south pole at the periphery 44. A permanent magnet plate 46 of ferrite forming a non-magnetized region is fixed provided to a portion between the north and south poles. A vibration gap 47 between the diaphragm 31 and the upper surface of the permanent magnet plate 46 of ferrite is such that the diaphragm 31 does not come in contact with the permanent magnet plate 46 at the maximum amplitude of diaphragm 31.

The action and effect of the sound generating element of this type are similar to those of the sound generating element of the aforesaid type.

In the electromagnetic type acoustic tranducers 10 and 30 illustrated in FIGS. 1 to 4, the respective support members 19 and 39 have a M-shaped configuration in section and a single folded portion, but they may have a plurality of folded portions extending in opposite directions with each other. On the other hand, the conductors 12 and 32 of the sound generating elements are formed on one sides of the thin films, while the permanent magnet plates 26 and 46 are disposed one sides of diaphragms 11 and 31. However, conductors may be formed on both sides of a thin film, which are connected to each other at the center of a diaphragm. Alternatively, permanent plates may be disposed on both sides of a diaphragm. When the permanent magnet plates are provided on both sides of the diaphragm, it is required to form a number of perforations in the central annular non-magnetized portion of each permanent magnet plate.

Figure 5:
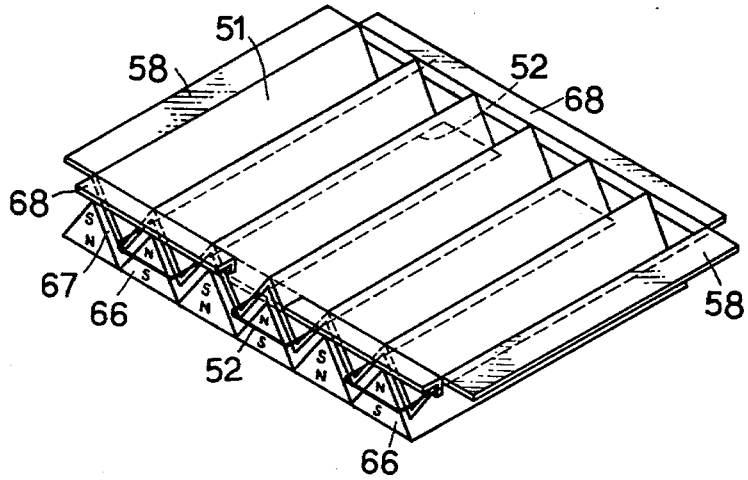
FIG. 5 is a perspective view of a sound generating element for other electromagnetic type acoustic transducer intended for use in loudspeakers according to the present invention.

As shown in FIG. 5, a sound generating element for further electromagnetic type acoustic transducer intended for use in loudspeakers in accordance with the present invention is a square, bellows-like diaphragm 51. This diaphragm 51 is formed by folding a thin film of the same material as the foregoing diaphragm 11 such that projecting portions with a triangular configuration in section are successively formed. The respective roots of the bellows of diaphragm 51 are provided with a conductor 52 in zigzag relation and in series therewith. The conductor 52 is then caused to conduct sound currents in alternate directions.

To both sides of diaphragm 51 at right angles with the bellows are firmly bonded support rods 68 such that they are flush with the periphery 58 of diaphragm 51. Each support rod 68 is of a 7-shaped configuration in section, and is formed of aluminium or metallic tiranium. This rod is also of light weight and undergoes no deformation due to the vibrations of diaphragm 51. The periphery 58 and the support rods 68 are supported to a frame in suspension fashion by means of support members which are similar to the support members 19 as shown in FIGS. 1 and 2. The diaphragm 51 is provided at its back with ferrite-made permanent magnets 66 in the form of triangular rods which set up magnetic fluxes at right angles with the conductor 52 arranged on the roots. Numeral 67 here denotes a vibration gap. When a plurality of conductors 52 are arranged on each root in such a manner that they are caused to conduct sound currents in the same direction, a larger output is obtained which is suitable for use in loudspeakers.

Figure 6:
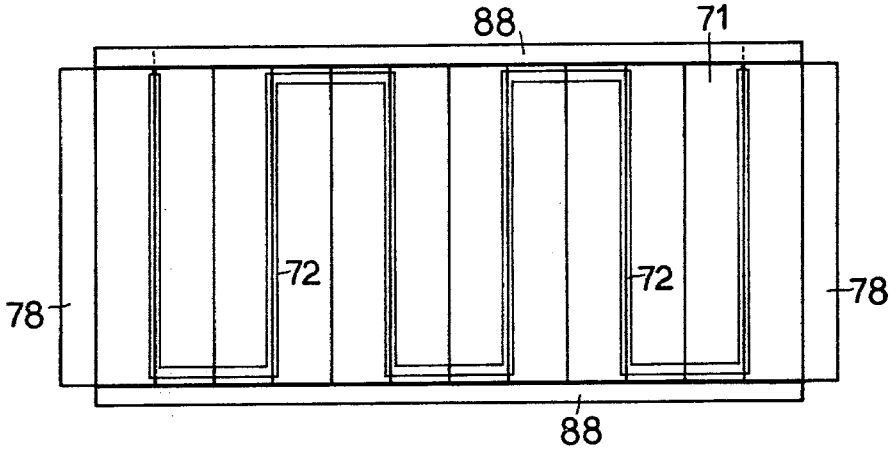
FIG. 6 is a plane view of a diaphragm for other electromagnetic type acoustic transducer designed for use in loudspeakers in accordance with the present invention.
Figure 7:
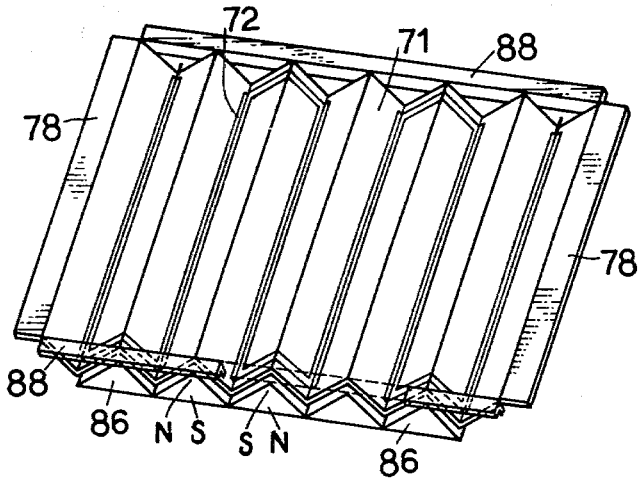
FIG. 7 is a perspective view of the sound generating element to which the diaphragm of FIG. 6 is applied.

As shown in FIGS. 6 and 7, a sound generating element for still further electromagnetic type acoustic transducer indended for use in loudspeakers is a square, bellows-like diaphragm 71. A corrugated conductor 72 is formed on a rectangular thin film formed of the same material as the thin film forming the diaphragm 11 shown in FIGS. 1 and 2 by known printing means. This conductor 72 is then folded such that the longitudinal conductor 72 provides root portions and the intermediate portions of the root portions provide crest portions, whereby projecting portions with a triangular configuration in section are sucessively formed.

To both sides of diaphragm 71 at right angles with the bellows are firmly bonded support rods 88 similar to the support rods 68 as shown in FIG. 5 in such a manner that they are flush with the periphery 78 of diaphragm 71. The periphery 78 and the support rods 88 are supported to a frame in suspension fashion by means of support members similar to the support members 19 shown in FIGS. 1 and 2. The diaphragm 71 is provided at its back with ferrite-made permanent magnets 86 which cause magnetic fluxes at right angles with a conductor 72 arranged on the root portions. The diaphragm 71 is also provided at its back with a conductor similar to conductor 72 with one ends of both conductors being connected to each other. Thus each root is provided at its surface and back with two conductors. When the conductors at the same root portion are caused to conduct sound currents in the same direction, a larger output is obtained which is suitable for use in loudspeakers.

The configuration of the diaphragms and permanent magnets for the sound generating elements used in the present invention is not limited to that illustrated. In other words, the diaphragm may be flat as a whole and may have at its peripheral edge a plane portion to which support members are mounted.

What is claimed is:

1. An electromagnetic type acoustic transducer comprising a vibratable diaphragm including a conductor and disposed within a magnetic field defined by a permanent magent, support members which are expandable and contractible in the direction at right angles with said diaphragm and are fixed to both surfaces thereof, and a frame to which said support members are fixed such that the expansion and contraction thereof are not prevented.

2. An electromagnetic type acoustic transducer as claimed in claim 1, in which said support members are folded and formed to a bellows-like state.

3. An electromagnetic type acoustic transducer as claimed in claim 2, in which said support members are formed of Japanese paper, cloth or unwoven fabric of the order of 0.01 to 0.07 mm thickness which is impregnated with silicon rubber paint, or a metallic titanium thin plate of the order of 0.01 to 0.05 mm thickness.

4. An electromagnetic type acoustic transducer as claimed in claim 1, in which a conductor defining spiral convolutions is formed on said diaphragm, and a permanent magnet is retained at a vibration gap with respect to said diaphragm.

5. An electromagnetic type acoustic transducer as claimed in claim 1, in which a conductor is formed on a rectangular diaphragm is zigzag relation which is, in turn, folded such that said conductor provides root portions with its intermediate portions providing crest portions, and permanent magnets in the form of triangular rods are disposed on the inner faces of the crest portions and retained at a vibration gap with respect to said diaphragm.

* * * * *